United States Patent [19]

Schuh

[11] Patent Number: 4,523,652

[45] Date of Patent: Jun. 18, 1985

[54] DRAINHOLE DRILLING ASSEMBLY AND METHOD

[75] Inventor: Frank J. Schuh, Dallas, Tex.

[73] Assignee: Atlantic Richfield Company, Los Angeles, Calif.

[21] Appl. No.: 510,013

[22] Filed: Jul. 1, 1983

[51] Int. Cl.[3] ..... E21B 7/08

[52] U.S. Cl. ..... 175/61; 175/73

[58] Field of Search ..... 175/73, 74, 75, 76, 175/79, 81, 406, 61, 62

[56] References Cited

U.S. PATENT DOCUMENTS

| | | | |
|---|---|---|---|
| 2,687,282 | 8/1954 | Sanders | 175/263 |
| 3,398,804 | 8/1968 | Holbert . | |
| 4,442,908 | 4/1984 | Steenbock | 175/73 |

*Primary Examiner*—James A. Leppink
*Assistant Examiner*—Thuy M. Bui
*Attorney, Agent, or Firm*—Robert M. Betz

[57] ABSTRACT

A bottomhole method and apparatus for drilling a curved borehole in the earth from a main bore to a lateral drainhole. The apparatus comprises a drill bit followed by a generally cone-shaped combination reamer and stabilizer tool extending to a knuckle joint, wherein the shape of the sidewall of the tool matches the shape of the curved borehole from the forward edge of the tool back to the knuckle joint. In operation, when the apparatus is deflected from the main bore, the drill bit is directed toward the top side of the borehole so as to drill a curved path. At the same time, stabilizing surface-to-surface contact is maintained between the curved sidewall of the reamer and the bottom side of the borehole, thus minimizing any tendency of the drill bit to deflect from the prescribed course and vary the prescribed angle of build.

5 Claims, 3 Drawing Figures

DRAINHOLE DRILLING ASSEMBLY AND METHOD

BACKGROUND OF THE INVENTION

1. Field of the Invention

This invention relates generally to the field of borehole drilling and more particularly to an improved method and apparatus for drilling a curved bore in drilling lateral drain holes in order to increase well production.

2. Description of the Prior Art

One way to achieve enhanced production from depleted wells is to drill short lateral holes known as "drain holes" from a main bore into a desired interval. The main bore and the horizontal drain hole are connected by a section of curved bore which builds at some predetermined angle such as 2° or 3° per foot. The apparatus for performing this task usually comprises several structures interconnected in descending order of the lower end of a drill pipe, including one or more lengths of flexible shaft, a knuckle joint, a reamer, and a drill bit. The initial direction of the curved bore is determined by a deflecting tool or whipstock. Since the diameter of the knuckle joint is less than that of the reamer and drill bit, the joint will be pushed toward the bottom edges of the deflecting tool. This places the common bit-reamer axis at an angle to the deflecting tool causing the bit, as soon as it clears the whipstock, to bite more sharply into the top bore surface, thus causing the bore to curve.

In order to be able to drill a drainhole in this manner so that the laterally or horizontally extending portion there of will be at the desired depth, it is essential to be able to predict accurately what the "build" angle will be. Failure to do so may lead to total failure of the drainhole to produce. This in turn requires correct determination of the relationship between the radius of curvature of the borehole and the geometry of the bottomhole drilling structure.

In U.S. Pat. No. 3,398,804 relating to a method of drilling a curved bore, utilizing the drill assembly elements described above, it is assumed that the borehole proceeds on a smooth curve which maintains the reamer in a position perpendicular to the radius of the curved path of the borehole. It is believed that this concept is in error and leads to incorrect calculations of borehole curvature. An equation for calculating borehole curvature and build angle must correctly identify the point of tangency between the direction of the bottomhole assembly and the borehole.

It is therefore an object of this invention to provide an equation for correctly correlating the borehole curvature and the bottomhole assembly dimensions.

A further problem in drilling drainholes arises when drilling into intervals of significantly varying hardness. For example, drilling operations in one instance revealed that a drainhole drilling assembly built to about 35° and then fell off to vertical before building again. This, of course, completely nullified any calculations concerning drainhole depth. This problem is generally attributed to the fact that the lateral forces generated by moving from one layer of the formation to another of different hardness tend to destabilize the bottomhole assembly and cause the reamer and bit to drill laterally instead of following concentrically along the correct path.

It is therefore a further object of this invention to provide a method and apparatus for minimizing the destabilizing effect on a drainhole drilling apparatus of passing between drilling intervals of varying hardness.

Other objects and advantages of this invention will become apparent from a consideration of the detailed description to follow taken in conjunction with the drawings and appended claims.

SUMMARY OF THE INVENTION

In a preferred embodiment of this invention, bottomhole drilling apparatus for drilling a curved bore of predetermined radius of curvature from a main bore in order to establish a drainhole comprises a drill bit followed in fixed concentric relation by a generally cone-shaped reamer which is in turn interconnected through a knuckle joint with a length of flexible shaft. The cylindrical sidewall of the reamer is tapered along its entire length rearwardly from the forward cutting edge on a curved path which matches the curvature of the borehole. With axial loading on the flexible drill shaft, the curved reamer sidewall is urged toward the bottom side of the borehole and makes contiguous surface-to-surface stabilizing contact therewith during drilling operations.

The above-referenced assembly is dimensioned so as to correlate with the equation $$R=(L^2+2\,LB)/2C$$

where R equals the radius of curvature of the borehole; L equals the distance along the reamer center line from its forward cutting edge to its rearward end; B equals one-half the axial distance between the front cutting edge of the drill bit and the forward cutting edge of the reamer and C equals one-half the difference in diameter between the front and rearward end of the reamer sidewall.

The present invention also comprises the method of minimizing lateral deviations from the prescribed curved path to be followed by the drill bit of the above apparatus comprising the step of extending the reamer sidewall rearwardly from its forward cutting edge along a path matching the curvature of the borehole thereby providing a stabilizing surface to bear against the bottom side of the borehole.

In an alternate embodiment of this invention the sidewall of the drill bit is also configured to match the curvature of the borehole, so that when the drill bit is directed toward the top side of the borehole its sidewall is also in contiguous surface-to-surface contact therewith.

A BRIEF DESCRIPTION OF THE DRAWINGS

DESCRIPTION OF THE PREFERRED EMBODIMENTS

Figure 1:
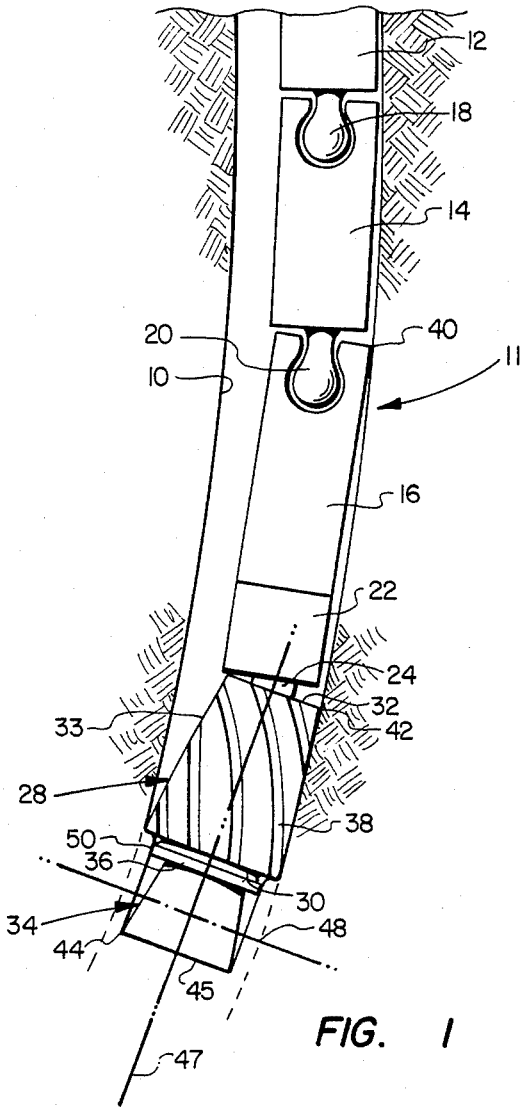
FIG. 1 is a drawing of a drilling structure in accordance with the preferred embodiment of this invention.

Referring now to FIG. 1, there is shown a section of reamed borehole 10 within which is disposed a bottomhole drilling assembly 11. Proceeding in a downward direction, assembly 11 first includes tubular sections 12, 14 and 16 of flexible drill shaft joined together by dovetailed, engaging wiggle joints 18 and 20. The lower end of section 16 is threadably joined to an upper knuckle joint section 22. By means of a universal torque-transmitting connector 24, upper section 22 is connected to a generally cone-shaped combination reamer and stabilizer tool 28 having a perimetric forward cutting edge 30, a rear surface 32 and a curved sidewall 33. Drill bit 34 is suitably interconnected with tool 28 below its forward edge 30 so that these two structures are held in fixed concentric relation. Forward of cutting edge 30, tool 28 is preferably provided with a narrow stabilizer section 36 which has the same diameter as the forward end of drill bit 34. The surface of tool 28 is indented with a plurality of water courses 38 extending upwardly in a spiral pattern from forward edge 30 so as to provide escape paths for the drilling fluid and accumulated cuttings.

Figure 2:
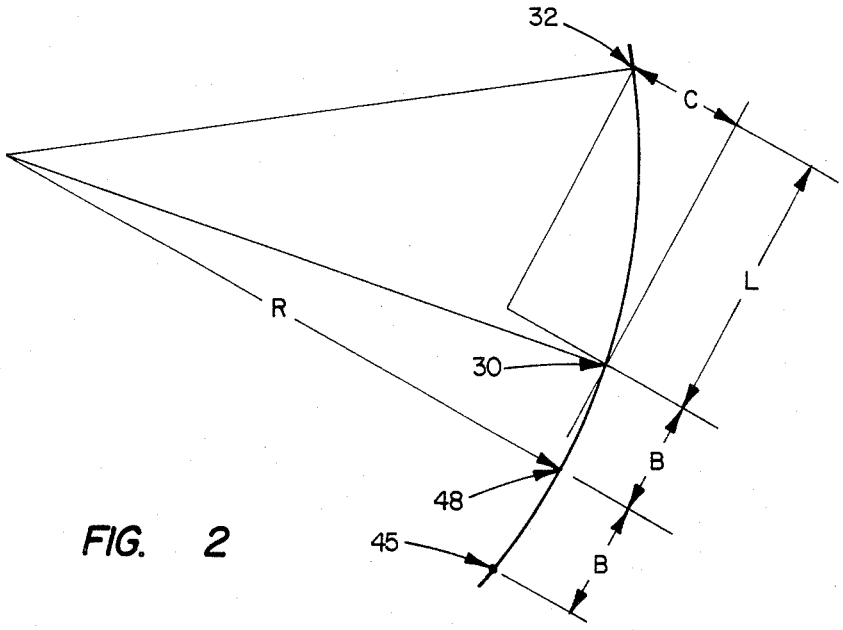
FIG. 2 is a diagram illustrating the dimensions of the assembly of this invention in relation to the prescribed radius of curvature of the borehole.

Under the influence of a suitable whipstock or deflecting tool (not shown) the assembly 11 is urged against the lower or bottom side of borehole 10, contact being made at a point 40 on the surface of shaft section 16 and at the rearward contact edge 32 of tool 28 such as at point 42. As will be seen, this also causes continuous surface-to-surface contact between sidewall 33 and the outside, or low side of, borehole 10. At the same time the drill bit 34 is urged toward the high or inner side of borehole 10 such as at point 44. In any position into which tool 28 is pushed responsive to axial loading of the reamer, the enlarged diameter hole formed by the cutting edge 30 is always exactly concentric with that reamed out by drill bit 34. This leads to the logical conclusion that the assembly 11 will drill a circular path such that the common axis 47 of tool 28 and bit 45 is always perpendicular to a radius emanating from a point 48 midway between the forward edge 45 of bit 34 and cutting edge 30 of tool 28. Based on this assumption, and as best seen in FIG. 2, the dimensions of assembly 11 are selected such that the relationship $$R=L^2+2\ LB/2\ C$$

holds true where R equals the radius of curvature of the borehole 10; L equals the distance along the reamer center line 47 from its forward cutting edge 30 to its rearward end 32; B equals one-half the axial distance between the front cutting edge 45 of the drill bit and the forward cutting edge 30 of the reamer and C equals one-half the difference in diameter between the front and rearward end 30 and 32 of the tool 28. In a typical example: L=13.62 inches, B=3.5 inches, and C=0.4065 inches. Using the above formula, the radius of curvature R may be calculated as 345.44 inches. From this one can further calculate the build angle as approximately 1.99° per foot.

A significant feature of this invention is that the shape of the sidewall of tool 28 should exactly coincide with the curvature of borehole 10. This makes tool 28 act not only as a reamer but also as a stabilizer. If assembly 11 progresses from a harder layer into a softer layer, unwanted lateral motion of bit 34 at point 44 is resisted by the pressure of the entire length of the sidewall 33 of tool 28 against the lower side of borehole 10. In this way, the ability of the drill bit-reamer combination to deflect upwardly or downwardly so as to change the build angle is minimized. The reliability of any calculation as to the progress and position of the drainhole is therefore enhanced. It is apparent that to achieve this effect, the shape of tool 28 must be determined in accordance with the above-stated curvature equation.

As a further feature of this invention, section 36 of tool 28 also serves to stabilize the motion of bit 34 by bearing against the upper side of borehole 10 at point 50 until the enlarged diameter cutting edge 30 of tool 28 reaches that point.

Figure 3:
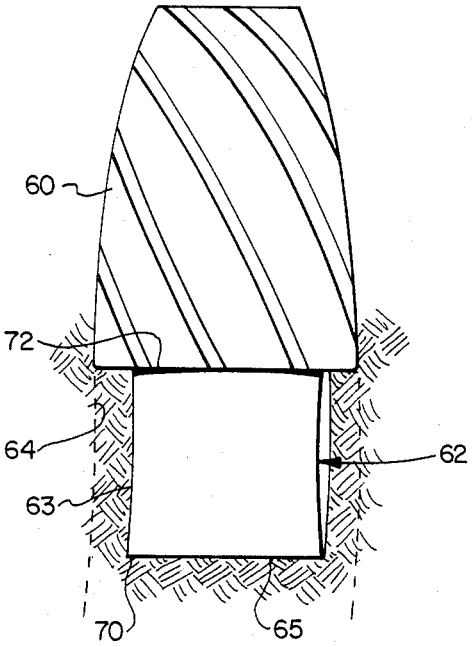
FIG. 3 is a drawing of an assembly in accordance with an alternate embodiment of this invention.

In accordance with an alternate embodiment of this invention depicted in FIG. 3, a combination reamer-stabilizer tool 60 is concentrically joined to a drill bit 62 and disposed within borehole 64. The sidewall 63 of drill bit 62 is given a concave shape which matches the curvature of borehole 64. As drill bit 62 performs the drilling operation, the sidewall 63 of bit 62 is in continuous contact with the upper side of hole 64 from the front cutting edge 65 of bit 62 at point 70 to its rear edge 72 where it joins tool 60. This further minimizes the ability of the bit 62 to deflect improperly from the prescribed build angle.

Within the scope of this invention a drill bit and combination reamer/knuckle-joint tool such as described in FIG. 3 may be manufactured as a single assembly unit. In this way, the bit and reamer may be readily changed to accommodate a different build angle.

The shape and arrangement of components in accordance with the foregoing description is to be regarded as illustrative only and those skilled in the art will have no difficulty in selecting modifications thereof without departing from the scope of this invention as more particularly set forth in the appended claims.

I claim:

1. A bottom-hole assembly for drilling a curved borehole in the earth from a main bore comprising in combination:

(a) a drill bit;

(b) a generally cone-shaped reamer in fixed concentric following relation to said drill bit, said reamer having a cylindrical sidewall terminating forwardly in a perimetric cutting edge from which said sidewall tapers smoothly in a rearward direction to substantially the rearward end of said reamer along a curved path which matches the desired curvature of said borehole; and (c) a knuckle joint for interconnecting said rearward end of said reamer in torque-transmitting relation with a flexible drill shaft, whereby when an axial load is applied to said drilling shaft said tapered reamer sidewall maintains continuous stabilizing contact with the outside of said borehole.

2. Apparatus as claimed in claim 1 wherein the dimensions of said assembly conform to the equation $$R=L^2+2\ LB/2\ C$$

where R equals the radius of curvature of the outside of said borehole; L equals the distance along the reamer center line from its forward cutting edge to its rearward end; B equals one-half the axial distance between the front cutting edge of the drill bit and the forward cutting edge of the reamer and C equals one-half the difference in diameter between the front and rearward end of the reamer sidewall.

3. Apparatus as in claim 1 wherein the diameter of said reamer forward cutting edge is greater than the diameter of said drill bit.

4. Apparatus as in claim 1 further including a stabilizing section of said reamer forward of said forward cutting edge, said stabilizing section having an outer diameter equal to that of the diameter of the cutting edge of said drill bit, said section being adapted to maintain contact with said borehole.

5. In a bottom-hole assembly for drilling a curved borehole in the earth comprising in combination a drill bit, a following reamer in fixed concentric relation thereto, and a knuckle joint for interconnecting said reamer in torque-transmitting relation with a flexible drill shaft, whereby in response to axial loading on said drill shaft said knuckle joint and reamer are urged toward the outside of said borehole and said drill bit is directed toward the inside of said borehole so as to cut a curved path, the improvement wherein the sidewall of said drill bit is inwardly curved from its front to its rear end along a path which matches the desired curvature of the upper side of said borehole, whereby when said drill bit is advancing, said inwardly-curved sidewall is in continuous contact with the top of said borehole.

* * * * *